US006221158B1

(12) United States Patent
Kondo

(10) Patent No.: US 6,221,158 B1
(45) **Date of Patent: *Apr. 24, 2001**

(54) APPARATUS AND METHOD FOR INTERMITTENTLY COATING A TAPE

(75) Inventor: Naoki Kondo, Cheshire (GB)

(73) Assignee: YKK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/080,394

(22) Filed: May 19, 1998

(30) Foreign Application Priority Data

May 20, 1997 (GB) ..... 9710401

(51) Int. Cl.[7] ..... B05C 1/12; B05C 11/00; B05D 1/28

(52) U.S. Cl. ..... 118/258; 118/247; 118/249; 118/263; 118/261; 427/428; 156/446; 156/539; 156/578

(58) Field of Search ..... 118/253, 247, 118/249, 261, 265, 258; 427/428; 156/446, 447, 578, 539

(56) References Cited

U.S. PATENT DOCUMENTS 3,830,199 * 8/1974 Saito et al. ..... 118/637
3,926,148 * 12/1975 Honsel ..... 118/247
3,991,708 * 11/1976 Huebschmann et al. ..... 118/44
4,082,059 * 4/1978 McIntyre et al. ..... 118/407
4,277,301 * 7/1981 McIntyre et al. ..... 156/446
5,523,122 6/1996 Harada et al. ..... 427/287
5,582,868 * 12/1996 Harada et al. ..... 427/287

FOREIGN PATENT DOCUMENTS 0 222 594 A2 5/1987 (EP) .
672952 5/1952 (GB) .

* cited by examiner

*Primary Examiner*—Richard Crispino
*Assistant Examiner*—J. A. Lorengo
(74) *Attorney, Agent, or Firm*—Finnegan, Henderson, Farabow, Garrett & Dunner, L.L.P.

(57) ABSTRACT

A header tape for a curtain or the like comprises loop regions for use with a hook and loop fastener. The loop regions cause the header tape to be thicker in these regions. The loops of the loop regions will be pulled out under constant use unless the back of regions are coated by an adhesive. Using the difference in thickness between loop regions and the non-loop region, intermittent coating can be achieved by feeding the header tape through a small gap between a press roller and a coating roller. The gap is chosen so that it is smaller than the thickness of the loop regions but larger than the thickness of the non-loop region of the header tape.

5 Claims, 4 Drawing Sheets

APPARATUS AND METHOD FOR INTERMITTENTLY COATING A TAPE

BACKGROUND OF THE INVENTION

1. Field of the Invention

The present invention is concerned with tapes such as header tapes for a curtain or the like, and more particularly it relates to an apparatus for coating the header tape and a method for coating the header tape.

2. Description of the Related Art

Header tapes are attached to the upper ends of a curtain, or other hanging material, to receive hooks for hanging the curtain and to form pleats in the curtain or gather it.

The curtain header tape which the present invention is concerned with uses a hook and loop fastener system to affix the curtain in position on a rail. The header tape is provided with a loop type fastener for engaging with a hook type fastener located on, for example, a curtain hook.

Hook and loop fastener have been used in systems for hanging curtains. In one such system, described in EP-A-612 493, a strip of loop material is attached to the top of the curtain. The curtain hooks, for hanging the curtain from a rail, have a plate-like surface with hooks molded on it for engagement with the loops of the header tape. These systems are particularly useful for industrial purposes where curtains are to be removed frequently or with the minimum of effort.

However, the problem with using such loop material is that the loops need to be fixed into the header tape so that they do not pull out during continual use. A solution to this problem is to coat the side of the header tape opposite to the looped side with an adhesive which will secure the loops on place so as to stabilize the looped surface. This has the problem that it makes the header tape very stiff and makes it very hard to gather or pleat the header tape and hence the curtain if the user so wishes.

A solution to this is that since the loop material is restricted to be provided in certain discrete spaced apart regions of the header tape, these regions are coated with adhesive. Such a header tape is awkward to manufacture because of the difficulty in selecting to coat only the loop regions in the coating operation.

SUMMARY OF THE INVENTION

Therefore, in a first aspect the present invention is concerned with an apparatus for intermittently coating a header tape as described above.

According to a first aspect, the present invention provides an apparatus for intermittently coating a header tape, comprising a coating roller for coating the header tape, a press roller for pressing the header tape against the coating roller and tension means for keeping the header tape under tension against the press roller. In the apparatus, the header tape to be coated has engaging means composed of a plurality of engaging elements for a hook and loop fastener woven into the tape, the plurality of engaging elements being provided in discrete spaced apart engaging regions, such that the engaging regions are thicker than the plane of the tape, and the press roller is positioned relative to the coating roller such that the coating roller only coats the thicker regions of the header tape.

The present invention therefore, relies on variations in the thickness of the header tape due to the engaging regions to ensure that only the back of the engaging regions are coated leaving the rest of the header tape where the header tape is not coated to move freely, and it is not necessary to provide a mechanism for coordinating the coating operation with the detection of the engaging regions.

Therefore, in a second aspect, the present invention provides a method for intermittently coating a surface of a header tape which has a variation in thickness in the plane of the header tape. The method comprises the steps of: coating a coating roller with a liquid; passing the header tape between a press roller and a coating roller, wherein the distance between the press roller and the coating roller is such that only the thicker regions of the header tape contact the coating liquid; and maintaining tension of the header tape so that the header tape is kept to be under tension as it passes over the press roller.

As mentioned above, it may be preferable to hang the curtain in a shape of pleats or gathers. This is achieved by a pull cord or cords which run through the length of the header tape and, with the header tape attached to a curtain, the pull cords are pulled through from one end of the header tape to bunch up the body of the header tape to have pleats or gathers in the header tape and the curtain.

This presents a problem in the manufacture of header tapes where a coating needs to be applied to the tape to stop the engaging elements being pulled out as there is a chance that the adhesive coating will stick to the pull cord and impair its performance. Therefore, it is preferable that the press roller of the apparatus in accordance with a first aspect of the present invention is provided with grooves such that when the header tape is fed over the press roller under tension, the pull cord fits into the groove and is thus not coated with the coating.

Similarly, it is preferred in accordance with a second aspect of the present invention if the method further comprises a step of placing the header tape under tension so that the pull cord embeds itself into a groove provided on the press roller.

A third aspect of the invention provides a method of coating a header tape, the header tape having regions of increased thickness along its length. The method comprises the steps of: passing the header tape through a gap formed by two spaced apart surfaces; providing a coating material at one of the surfaces; holding the header tape against the other surface and controlling the gap so that the header tape extends around the gap to contact the coating material only at the thicker regions of the header tape.

DETAILED DESCRIPTION OF THE PREFERRED EMBODIMENTS

Embodiments of the invention will now be described in detail with reference to the accompanying drawings.

Figure 1:
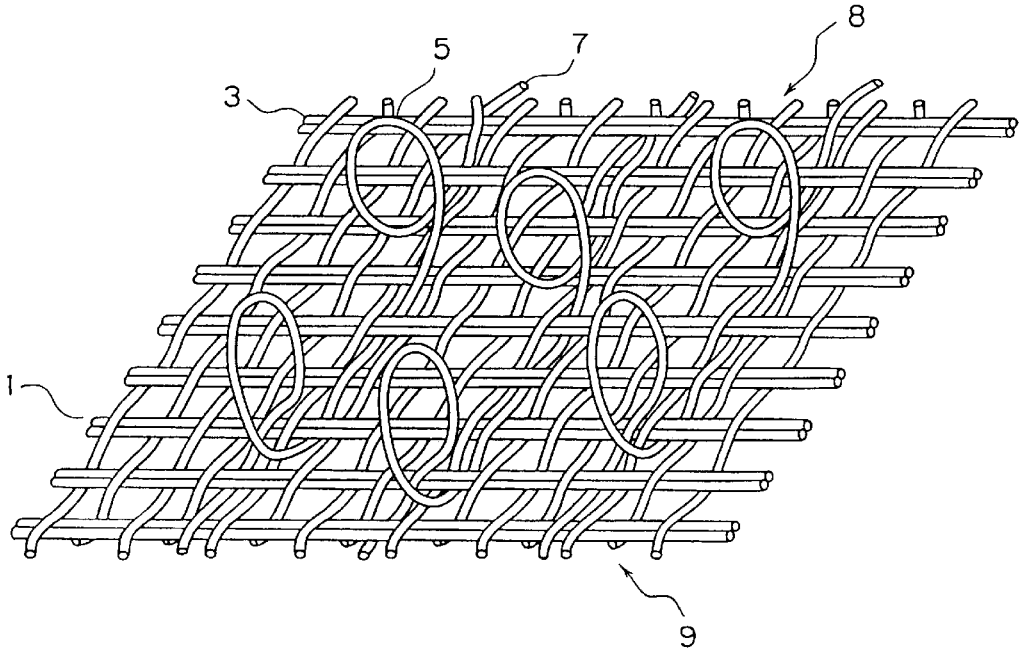
FIG. 1 is a fragmentary perspective view showing a structural example of a loop region of the header tape of the invention.
Figure 2A:
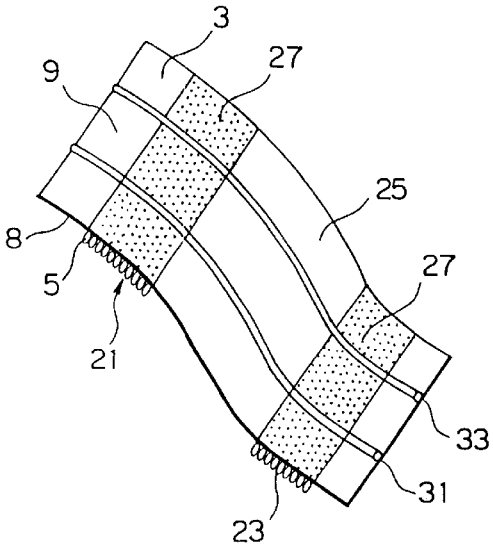
FIGS. 2A and 2B are fragmentary perspective views showing examples of the header tape of the invention.
Figure 2B:
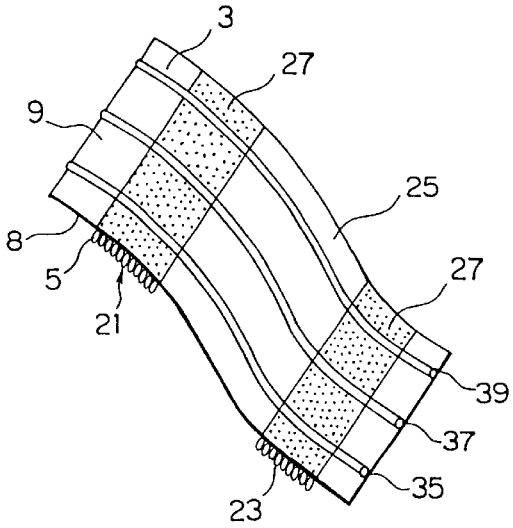

FIG. 1 shows a woven tape material 3, in which loop regions of a header tape 1 illustrated in FIGS. 2A and 2B are formed. Woven into the tape material 3 are loops 5. The loops 5 project upwards away from the plane of the material 3. It can be seen, that the loops are formed from a warp thread 7 which is woven into the tape material 3. Therefore, pulling the loops 5 will result in the thread 7 being pulled out of the tape material 3. This also happens in the case that hooks are formed instead of the loops.

In order to overcome this problem an adhesive is applied to the back surface 9 of the tape material 3. This holds the threads 7 in place.

FIGS. 2A and 2B show two header tapes. In FIGS. 2A and 2B, the loops 5 are formed in regions 21 and 23 spaced intermittently along the length of the tape 3 and project from a front surface 8. Adhesive 27 as acoating material is applied to the back surface 9 of the tape 3, at 21 and 23.

In FIG. 2A, two pull cords 31 and 33 are seen to extend through the tape material 3. These are to gather the tape material 3 to form pleats or gathers. In FIG. 2B, three pull cords are shown 35, 37 and 39. In the following description, the loops are described as engaging elements, but hooks may be used instead.

It can be seen clearly in both FIGS. 2A and 2B that the loops 5 of the loop regions 21, 23 extend above the plane of the tape material 3. In other words, the loop regions 21 and 23 serving as engaging regions are thicker than the non-loop region 25.

Figure 3A:
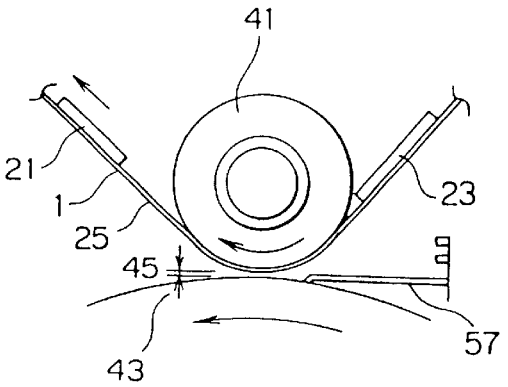
FIGS. 3A and 3B illustrate a coating method in accordance with the present invention.
Figure 3B:
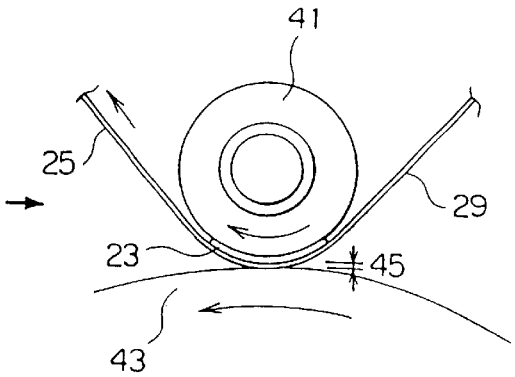

FIGS. 3A and 3B illustrate a method for intermittently coating the header tape 1, at only the loop regions 21, 23. In FIG. 3A, apress roller 41 is shown positioned above a coating roller 43. The header tape 1 is passed through a gap 45 between the press roller 41 and the coating roller 43. The header tape 1 is passed through the gap 45 under tension so that header tape 1 is pulled against the press roller 41. On the header tape 1, the loop regions 21 and 23 can be seen to be thicker than the non-loop region 25 which extends between the two loop regions. The gap 45 between the press roller 41 and the coating roller 43 is large enough so that the non-loop regions 25 pass around the press roller 41 without touching the coating roller 43. Therefore, in this arrangement the non-loop regions 25 are not coated by the coating roller 43.

FIG. 3B shows the same arrangement as FIG. 3A except that here the header tape 1 has moved to a position where the thicker loop region 23 is in the gap 45 between the press roller 41 and the coating roller 43. It can be seen that the thicker material is thick enough so that the back of the loop region 23 connects with the coating roller 43 and is thus coated.

Figure 4:
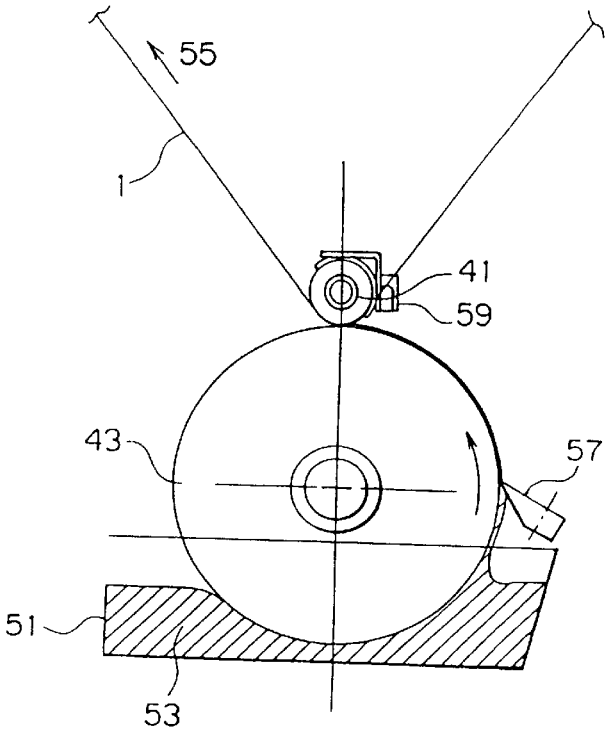
FIG. 4 shows a press roller and a coating roller arrangement in accordance with the present invention.

FIG. 4 shows a part of a coating apparatus. The coating roller 43 sits in a bat 51 of coating liquid 53. The header tape 1 is moved in the direction of the arrow 55. As the coating roller 43 rotates it picks up a layer of coating liquid 53. A coating blade 57 limits the thickness of coating liquid 53 on the coating roller 43.

The press roller 41 is shown here as a smaller wheel, a guide 59 is there to ensure smooth feeding of the header tape 1 onto the press roller 41. The press roller 41 will now be described in more detail with reference to FIG. 5.

The press roller 41 comprises a spindle 63 and a rotatable sleeve 65. In most practical situations, the header tape to be coated will be provided with pull cords. In order to ensure that the pull cords are not coated by the coating liquid 53, grooves 61 are provided on the surface of the rotatable sleeve 65. Referring back to FIG. 2B, the three pull cords shown 35, 37 and 39 will align with the grooves 61 provided on the rotatable sleeve 65. If the header tape 1 is fed with the pull cords 35, 37, 39 under tension then these will fit snugly into the grooves 61 and hence will not contact the coating roller 43 during coating.

Figure 5:
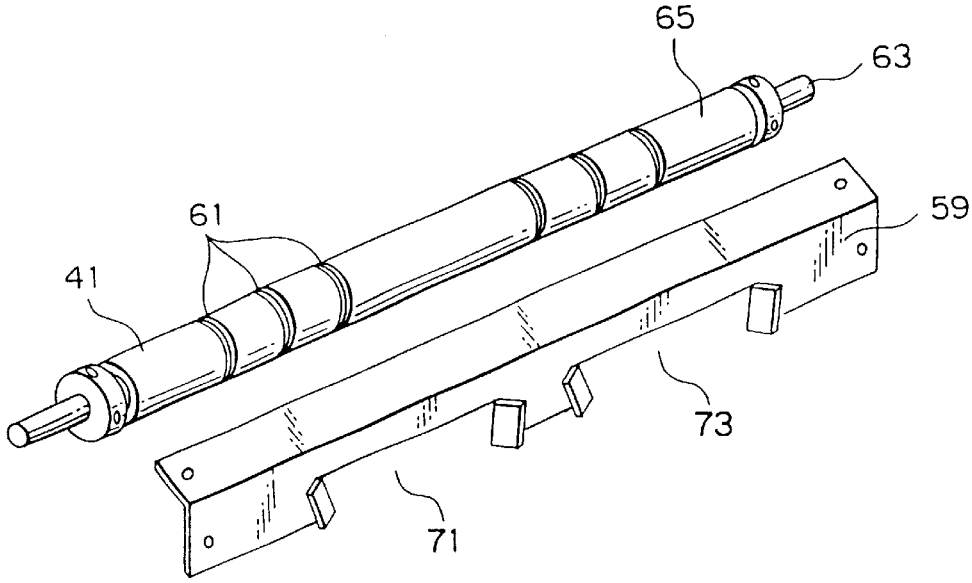
FIG. 5 shows the press roller with grooves and a guide in accordance with a preferred embodiment of the present invention.

The guide 59 is also shown in FIG. 5. This is a plate with two large openings 71 and 73 provided in it. This is to allow two reels of header tapes 1 to be fed through the grooves 71, 73 onto the press roller 41 such that the pull cords 35, 37 and 39 align with the grooves 61.

Figure 6:
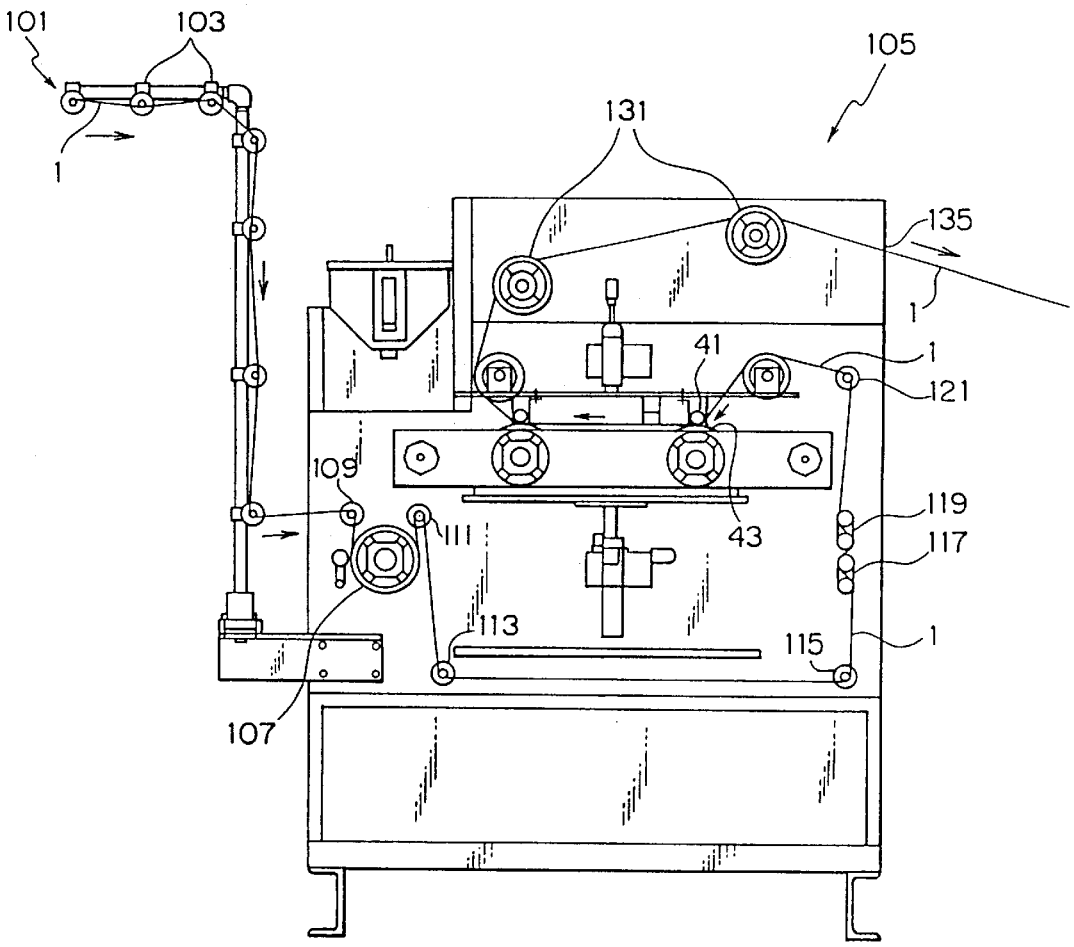
FIG. 6 shows an apparatus for performing intermittent coating on the header tape in accordance with the present invention.

FIG. 6 shows an intermittent coating apparatus 105 according to the present invention. The header tape 1 is fed in through the opening 101 and passed through guide means 103. The header tape 1 then enters the body of the apparatus 105. Once inside the body of the apparatus 105, the header tape 1 is passed around tension wheel 107 via tension guide wheels 109 and 111. The tension wheel 107 is provided with means to adjust the tension of the header tape 1 as it passes through the main body of the apparatus 105. The header tape 1 is then passed over more guide wheels 113, 115 until it reaches pulleys 117, 119. The pulleys 117, 119 also serve to maintain a constant tension on the header tape 1 as it passes through the main body of the apparatus 105. The header tape 1 is then fed via guide wheel 121 over the press roller 41 and hence through the gap 45 between the press roller 41 and the coating roller 43. The header tape 1 is then fed through a succession of further tension rollers 131 until it emerges from the main body of the apparatus 105 at point 135.

Two coating stations may be provided, although for most applications a single coating station is sufficient.

In light of this disclosure, modifications of the described embodiment, as well as other embodiments, all within the scope of the present invention as defined by the appended claims, will now become apparent to a person skilled in the art.

What is claimed is:

1. A method for intermittently coating a surface of a header tape which has a variation in thickness in the plane of the header tape, comprising the steps of:

(a) coating a coating roller with a liquid;

(b) passing the header tape between a press roller and a coating roller; and (c) maintaining tension of the header tape so that the header tape is kept to be under tension as it passes over the press roller;

wherein the distance between the press roller and the coating roller is such that only the thicker regions of the header tape contact the coating liquid.

2. A method for intermittently coating a surface of a header tape according to claim 1, wherein the header tape comprises a pull cord extending through the header tape for gathering it when in use, the method further comprises the step of:

placing the header tape under tension so that the pull cord locates itself into a groove provided on the press roller.

3. A method for intermittently coating a surface of a header tape according to claim 1 or 2, wherein two coating rollers are covered in liquid and two press rollers are provided to press the header tape against the two coating rollers.

4. A method of coating a header tape, the header tape having regions of increased thickness along its length, the method comprising the steps of:

(a) passing the header tape through a gap formed by two spaced apart surfaces;

(b) providing a coating material at one of the surfaces; and (c) holding the header tape against the other surface and controlling the gap so that the header tape extends around the gap to contact the coating material only at the thicker regions of the header tape.

5. A surface fastener tape coating system, comprising:

a surface fastener tape having a plurality of engaging element regions spaced apart by intermediate regions, the engaging regions having a thickness greater than a thickness of the intermediate regions;

a first roller; and a tape coating roller spaced apart from the first roller by a gap larger than the thickness of the intermediate regions, the surface fastener tape being carried on the first roller through the gap and alternatively in contact with the coating roller when the engaging regions are in the gap and out of contact with the coating roller when the intermediate regions are in the gap.

* * * * *